US006405630B1

(12) United States Patent
Gonzalez

(10) Patent No.: US 6,405,630 B1
(45) Date of Patent: Jun. 18, 2002

(54) FORAMINOUS BALLISTIC GRILL

(75) Inventor: Rene' G. Gonzalez, Southfield, MI (US)

(73) Assignee: The United States of America as reresented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/707,292

(22) Filed: Nov. 3, 2000

(51) Int. Cl.[7] ..... F41H 05/04; F41H 05/02; F41H 05/00

(52) U.S. Cl. ..... 89/36.02; 89/36.01

(58) Field of Search ..... 89/36.02, 36.04, 89/36.01

(56) References Cited

U.S. PATENT DOCUMENTS 3,736,838 A * 6/1973 Butterweck et al. ..... 109/83
4,198,454 A * 4/1980 Norton ..... 102/303
4,325,283 A * 4/1982 Bemiss ..... 180/68.6
5,628,682 A * 5/1997 Gonzalez ..... 454/143
5,753,847 A * 5/1998 Middione et al. ..... 89/36.02
5,760,327 A * 6/1998 Alexander ..... 342/14
5,780,761 A * 7/1998 Musante et al. ..... 89/36.02
5,880,394 A * 3/1999 Kim ..... 296/188
6,200,664 B1 * 3/2001 Figge et al. ..... 102/303

* cited by examiner

*Primary Examiner*—Charles T. Jordan
*Assistant Examiner*—John W. Zerr
(74) *Attorney, Agent, or Firm*—David L. Kuhn; Gail S. Soderling; Clifford Clay Carter

(57) ABSTRACT

A foraminated, laminated ballistic grill for armored vehicles has a hard outer layer of ballistic material with a plurality of projections having angled faces on the exposed surface. A ductile inner layer adapted to trap and contain ballistic fragments and projectiles backs the outer ballistic surface. A multiplicity of shaped foramina pass through the inner and outer layers to allow air flow into the grill, the foramina have a curved channel, wherein at least a portion of the channel is offset from the longitudinal axis of the inlet so a particle entering the inlet is forced to travel a curved tortuous path.

4 Claims, 3 Drawing Sheets

FORAMINOUS BALLISTIC GRILL

GOVERNMENT INTEREST

The invention described here may be made, used and licensed by The United States Government for governmental purposes without paying me any royalty.

BACKGROUND OF THE INVENTION

1. Field of the Invention

In one aspect this invention relates to the protective grills used in armored vehicles. In a further aspect this invention relates to a unique structure for protecting armored vehicles from ballistic particles while allowing airflow through the grill.

2. Prior Art

In general ballistic grilles have traditionally been made with a plurality of shaped, chevron or s-curve shaped slats arranged in an overlapping pattern. The slats are arranged so there is no direct straight-line path by which a projectile can pass from the outside through the grill. Various different arrangements are used and the slats have been formed with different materials so as the fragment or projectile hits the grill the particle is slowed and the force is then absorbed with the ballistic fragment or projectile being trapped in the grill.

Such designs have been used for decades with little or no basic change in design other than an occasional change in material or spacing to increase shock absorption or reduce particle ricochet.

SUMMARY OF THE INVENTION

Briefly, the present invention is a foraminated, laminated ballistic grill for armored vehicles. The grill is attached to a vehicle so as to protect vital vehicle components while still allowing cooling air to enter one or mote interior chambers of the vehicle. The grill has a hard outer ballistic layer of a ballistic material designed to stop deflect and/or fragment projectiles and other ballistic particles. The outer surface of the ballistic layer is formed with a textured surface having a plurality of projections. One example is to form the projections with a plurality of facets or other faces, these surfaces being disposed at an angle to the body of the ballistic layer. Forming the outermost surface with a texture presents a target surface that will interact with the incident projectiles and particles at an angle thereby minimizing the normal force the particle exerts on the ballistic layer and consequently reducing the particle's penetrating power.

The grill's ductile inner layer will be formed from a softer material adapted to trap and contain ballistic fragments and projectile pieces which have entered the apertures or penetrated the outer ballistic surface of the grill structure.

The grill has a multiplicity of shaped formanina passing through the inner and outer layers to provide a path for cooling air from the ambient atmosphere into the interior of the vehicle. Each of the foramina has a relatively small first opening on the outer surface of the ballistic panel in fluid contact with the ambient atmosphere to allow air flow into the grill and a second opening on the inner surface of the panel to allow air flow into a compartment within the vehicle. The first and second openings are offset from each other and connected by a curved channel. The channel provides the means of airflow between the first and second openings and is shaped so that at least a portion of the channel is offset from the longitudinal axis of the first opening. Thus, a particle that enters the first opening is forced to travel a curved tortuous path within the channel and will tend to burrow into the inner layer for entrapment.

DETAILED DESCRIPTION

Figure 1:
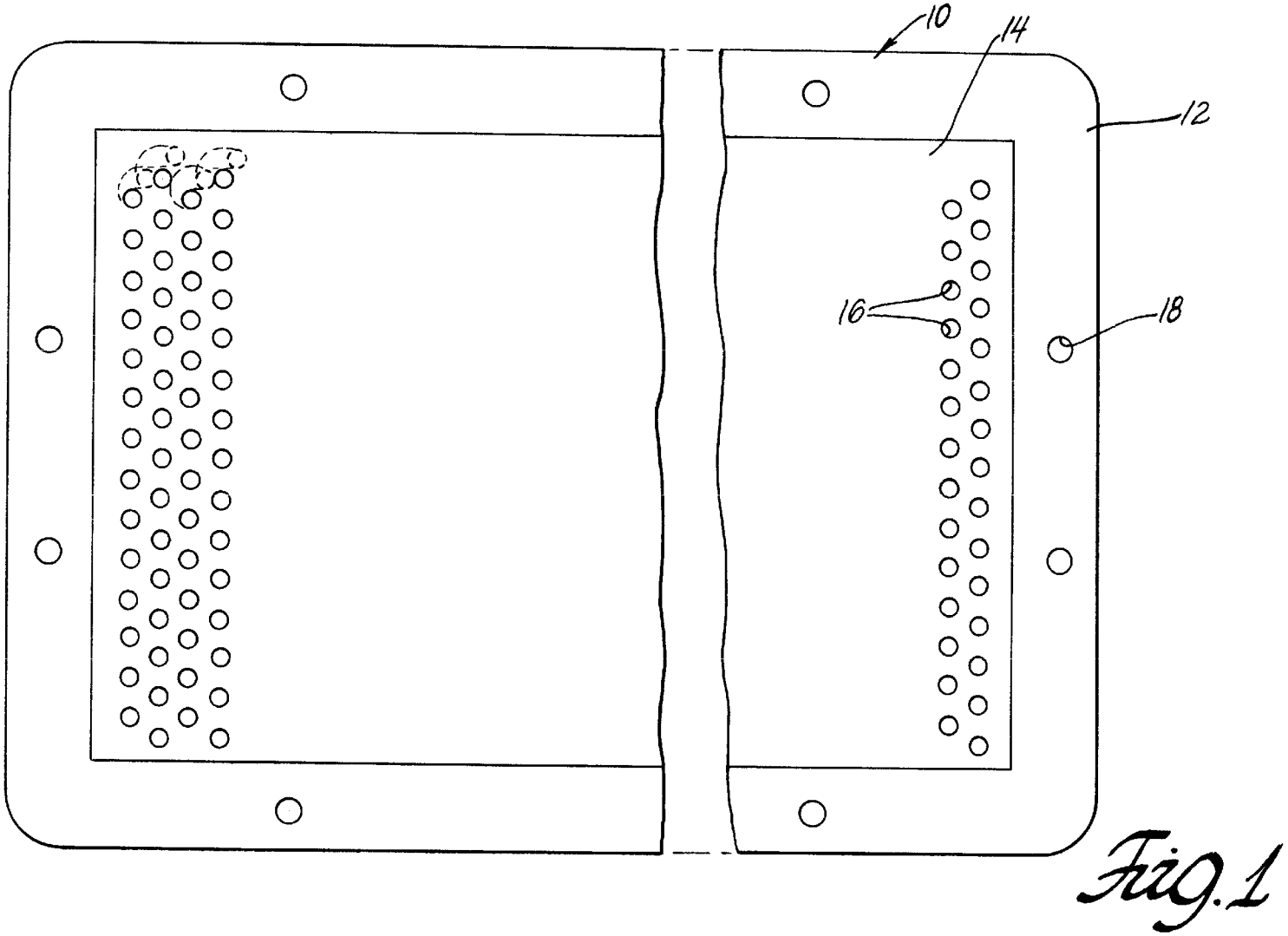
FIG. 1 is a back view of one embodiment of this invention.

Referring to the accompanying drawing in which like numerals refer to like parts and initially to FIG. 1, a ballistic grill 10 according to the present invention is shown as a foraminated structure having a frame 12 surrounding a center section 14 with a plurality of openings or foramina 16 for use on armored vehicles, not shown. The ballistic grill 10 is attached to the armored vehicle using fastening means such as threaded fasteners passing through apertures 18 formed in the frame 12 and mating with complimentary threaded apertures in the vehicle frame. The openings 16 are fluidly connected to the ambient atmosphere on the opposite side of the ballistic grill 10 so as to allow cooling air to enter one or more interior chambers of the vehicle protected by grill 10. Standard grill placement and attachment schemes are known in the art and further detailed description will be omitted in the interest of brevity.

Figure 2:
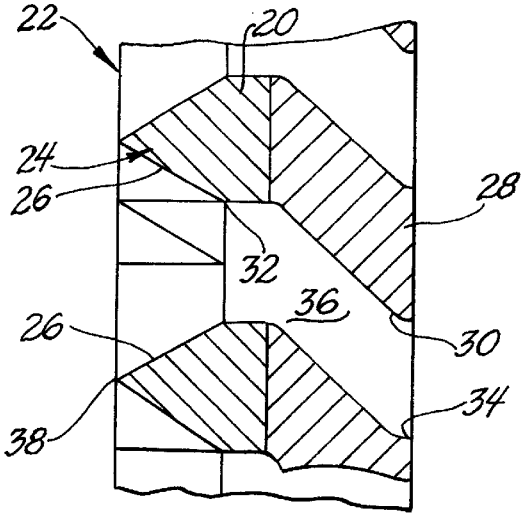
FIG. 2 is a partial side view of a grill according to this invention.

The internal structure of one embodiment of grill 10 is shown in greater detail in FIG. 2 the grill having a relatively hard outer ballistic layer 20 of a projectile resisting ballistic material. One example of suitable material is ballistic steel having a Brinell hardness of at least 400 and preferably over 500, designed to stop, deflect and/or fragment projectiles and other ballistic particles as they impinge on the outer surface. The outer face 22 of the ballistic layer 20 is shown formed with a plurality of shaped faceted projections 24. The faceted projections 24 are formed with a plurality of faces, the face surfaces being disposed at an acute angle to an axis orthogonal to the plane of the grill assembly 10. Forming the outermost surface of grill 10 with faceted projections 24 results in an outer surface 22 with an exposed surface that will maximize the probability that incident projectiles make contact at a glancing angle to the surface thereby minimizing the normal forces on the ballistic layer caused by incident projectiles.

The grill 10 has a ductile inner layer 28 formed from a softer material, such as aluminum, generally having a Brinell hardness of less than 350. This softer inner layer 28 is adapted to trap and contain any ballistic fragments and projectile pieces which have entered the apertures 16 or penetrated the outer ballistic layer 20 of the grill structure.

The grill 10 has a multiplicity of shaped formanina 30 passing through the inner layer 28 and the outer layer 20 to provide a path for cooling air from the ambient surroundings into the interior of the vehicle. Each of the foramina 30 has a relatively small first opening 32 on the outer surface 20 of the ballistic grill 10 in fluid contact with the ambient atmosphere to allow air flow into the grill and a second opening 34 in the inner layer 28 of the panel to allow air flow into a vehicle compartment. The sizing of the opening 32 is chosen so there is a high probability incident particles must first contact the textured surface so as to dissipate a portion of their energy. The first and second openings 32, 34 are offset from each other and connected by a shaped channel 36 to form the individual foramina 30. The channel 36 provides the means of air flow between the first and second openings 32, 34 and is shaped in a manner that at least a portion of the channel 36 is offset from the longitudinal axis of the first opening 32 so a particle which enters the first opening is forced to travel a curved tortuous path to follow the channel and will tend to burrow into the inner layer 28 for entrapment.

Figure 3:
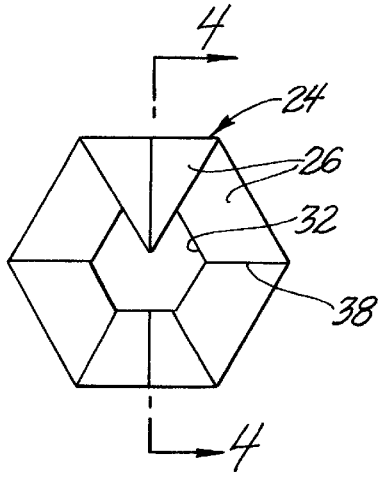
FIG. 3 is front view of one section of the grill showing a texture pattern.
Figure 4:
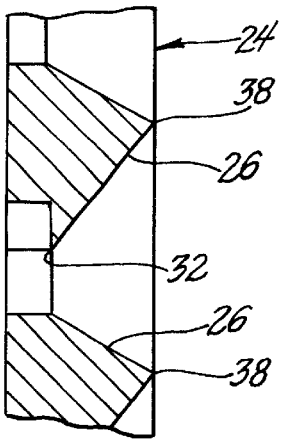
FIG. 4 is a sectional view of FIG. 3 taken along the line 4—4.

FIGS. 2, 3, and 4 show one faceted arrangement useful on the outer face 22 of the outer ballistic layer 20. FIG. 3 is one representation of a repeating tiling scheme which can be used to form the face 22 of the ballistic layer 20 which has a hexagonal perimeter with the first opening 32 disposed at the center of the hexagon. The faces 26 project outward from the ballistic layer 20 to form a plurality of raised knife-edges 38. Thus any projectile or fragment incident on the exposed face 22 will either tend to hit at an angle or contact a hard sharp edge either situation tending to disrupt the projectile's path, deflecting the impact and increasing the chances for entrapping the projectile. As shown best in FIG. 3, two of the faces are disposed so a corner of two faces extend partway across the opening 32 to partially occlude the opening. This substantially reduces the size of the opening's largest diameter with only a minimal reduction in airflow. The tiling pattern represented in FIG. 2 is reproduced across the surface of the grill to produce a fully textured surface, with partial tile patterns used at the edges of the grill.

The faces shown in the drawing are angular and meet at a sharp corner. The intersections could be radiused so the intersections are rounded. Both configuration and other texturing patterns can be used to provide a surface that interacts with a projectile to avoid being struck normal to the surface.

Figure 5:
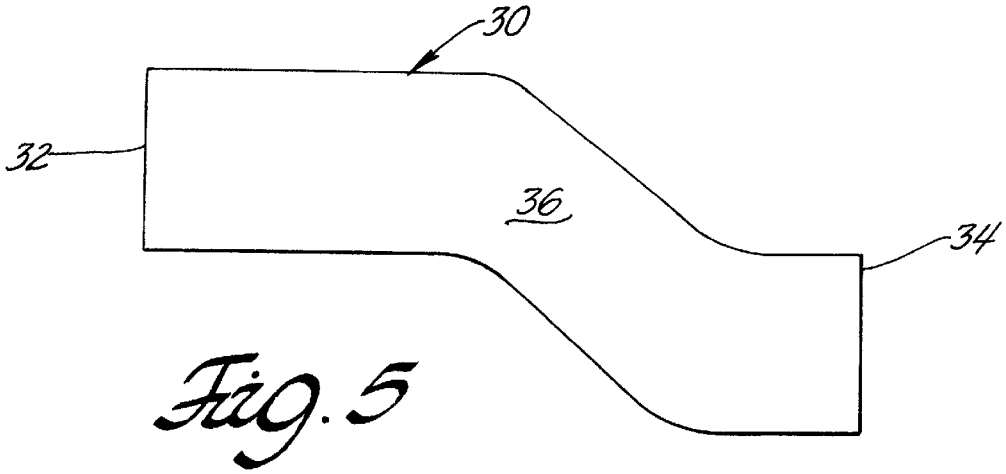
FIG. 5 is a side view of one internal channel.
Figure 6:
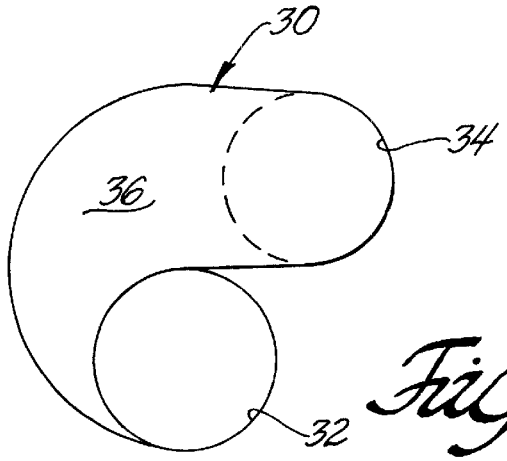
FIG. 6 is a back view of the channel of FIG. 5.
Figure 7:
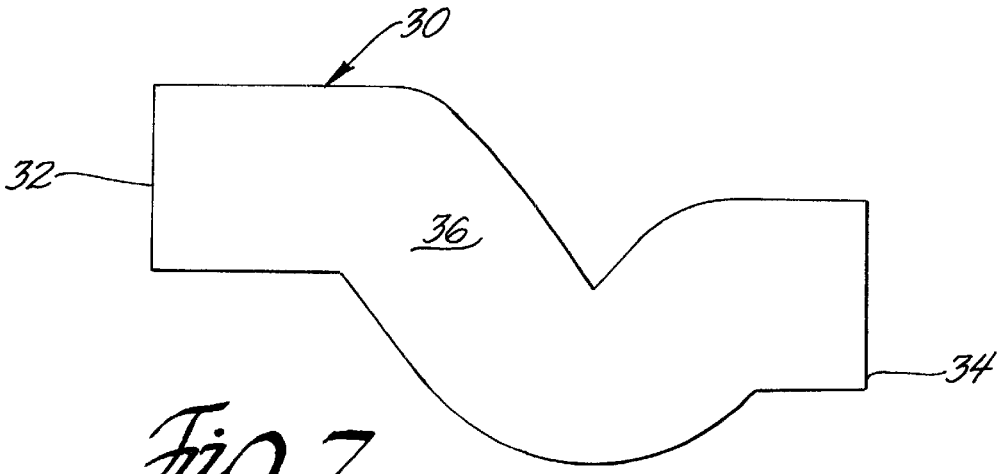
FIG. 7 is a top view of the channel of FIG. 5.

One possible interior channel configuration 30 is shown in FIGS. 5, 6, and 7. The channel 30 has the first opening 32 connected to the second opening 34 by means of a channel 36 which has a center axis defined by a locus of points traversing a helical path. The helical path results in the first opening 32 being offset from the second opening 34 and is shown best in FIG. 6, where the two openings are shown completely offset. By having the opening completely offset, projectiles must follow an extremely convoluted path to reach the second opening, which is virtually impossible. Also, by having the openings offset, the maximum amount of soft absorptive material must be penetrated before the particle pierces the absorptive layer.

Figure 8:
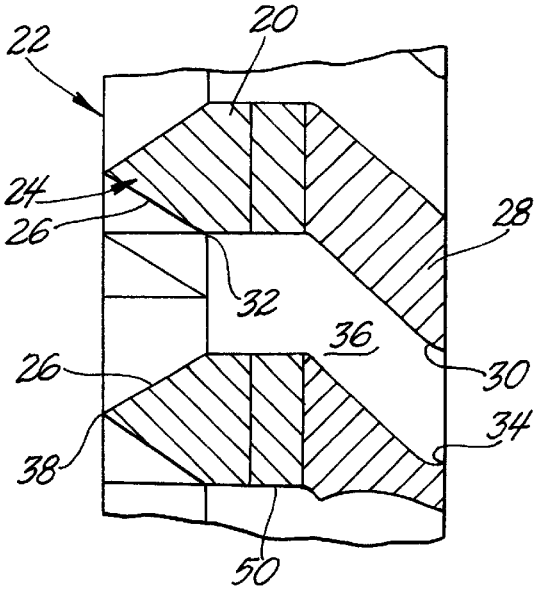
FIG. 8 is a side view in section of a second embodiment of this invention.

A second consideration in military vehicle technology is thermal signature. It is desirable whenever possible to minimize zones of higher relative temperature since these zones are readily discernable by thermal imaging sights commonly carried by troops in today's military. The variation represented by FIG. 8 shows an embodiment of this invention having a thermal layer 50 disposed between the ballistic layer 20 and the softer inner layer 28. The thermal layer 50 can be chosen from various materials which will retard the outward passage of heat through the grill and present a more uniform thermal signature at the ballistic layer 20. Examples would include ceramic fibers, glass batting and similar thermally resistant materials that can be incorporated between the first and second layers without degrading the ballistic properties of the outer layer 20. The thermal layer could also be an active cooling layer using some form of active heat absorption and transfer.

Various alterations and modifications will become apparent to those skilled in the art without departing from the scope and spirit of this invention and it is understood this invention is limited only by the following claims.

What is claimed is:

1. A foraminated, laminated ballistic grill mounted on an armored vehicles to allow cooling air to enter an interior chamber of the vehicle while protecting the chamber from ballistic particles comprising;

a body having a hard outer layer of a ballistic material, the outer layer having a plurality of projections formed thereon, the projections having a plurality of facets, the facets being disposed at an angle to the body;

a ductile inner layer adapted to trap and contain ballistic fragments and projectiles;

a multiplicity of shaped foramina pass through the inner and outer layers, each of the foramina having a first opening in the outer layer of the ballistic grill to allow air flow into the grill and a second opening in the ductile layer to allow air flow into a vehicle interior chamber the first and second openings being connected by a curved channel, the curved channel being in fluid communication with the first and second openings and shaped so that at least a portion of the curved channel is offset from the first opening so a ballistic particle entering the first opening of a foramina is forced to travel a curved tortuous path by the curved channel into the ductile inner layer for entrapment.

2. The grill of claim 1 where the curved channel is formed about a helical axis.

3. The grill of claim 1 where the outer layer is formed with a plurality of repeating pyramidal projections.

4. The grill of claim 1 having a thermal layer interposed between the hard outer layer and ductile inner layer the thermal layer serving to retard passage of heat from the interior chamber of the vehicle.

* * * * *